US011462110B2

(12) United States Patent
Ju et al.

(10) Patent No.: US 11,462,110 B2
(45) Date of Patent: Oct. 4, 2022

(54) METHOD FOR DETERMINING VEHICLE PARKING PLACE AND OPERATION SERVER UTILIZING THE SAME

(71) Applicants: Hyundai Motor Company, Seoul (KR); Kia Corporation, Seoul (KR)

(72) Inventors: Younghyun Ju, Yongin-si (KR); Kyong Enn Min, Seongnam-si (KR); Minwoo Kwak, Seongnam-si (KR); SungEun Kim, Seoul (KR); Gi Seok Park, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/368,571

(22) Filed: Jul. 6, 2021

(65) Prior Publication Data

US 2022/0165158 A1 May 26, 2022

(30) Foreign Application Priority Data

Nov. 26, 2020 (KR) ..... 10-2020-0161464

(51) Int. Cl.
*G08G 1/14* (2006.01)
*G08G 1/00* (2006.01)

(52) U.S. Cl.
CPC ..... *G08G 1/148* (2013.01); *G08G 1/142* (2013.01); *G08G 1/146* (2013.01); *G08G 1/202* (2013.01)

(58) Field of Classification Search
None
See application file for complete search history.

(56) References Cited

U.S. PATENT DOCUMENTS

| | | | | |
|---|---|---|---|---|
| 9,984,574 | B2 | 5/2018 | Laetz | |
| 2003/0107498 | A1* | 6/2003 | Drennan | G07C 9/27 705/5 |
| 2009/0083091 | A1* | 3/2009 | Rust | G06Q 10/063 705/400 |
| 2012/0200430 | A1* | 8/2012 | Spahl | G08G 1/143 340/932.2 |

(Continued)

FOREIGN PATENT DOCUMENTS

| | | | |
|---|---|---|---|
| JP | 2019-500681 | A | 1/2019 |
| KR | 10-1612047 | B1 | 4/2016 |

(Continued)

*Primary Examiner* — John F Mortell
(74) *Attorney, Agent, or Firm* — Morgan, Lewis & Bockius LLP

(57) ABSTRACT

A method for operating a parking place based on demand expectation, may include expecting n quantity of calls corresponding to a current time in a service area, deriving Nc quantity of assignment combinations that assign Nb quantity of vehicles in standby in the service area with respect to Na quantity of parking places positioned in the service area, with respect to each in the Nc quantity of assignment combination, allocating the expected n quantity of calls to Nd quantity of vehicles in the service area including the Nb quantity of vehicles, and deriving Nd quantity of total travel times of the Nd quantity of vehicles, and assigning a corresponding parking place from among the Na quantity of parking places to each in the Nb quantity of vehicles based on the Nd quantity of total travel times with respect to each in the Nc quantity of assignment combination.

32 Claims, 7 Drawing Sheets

(56) References Cited

U.S. PATENT DOCUMENTS

| | | | | |
|---|---|---|---|---|
| 2017/0138749 | A1 | 5/2017 | Pan et al. | |
| 2018/0374349 | A1* | 12/2018 | Mowatt | G08G 1/149 |
| 2020/0143306 | A1* | 5/2020 | Gao | G06Q 10/047 |
| 2021/0326783 | A1 | 10/2021 | Kim et al. | |

FOREIGN PATENT DOCUMENTS

| | | | |
|---|---|---|---|
| KR | 10-2016-0102894 | A | 8/2016 |
| KR | 10-2018-0003831 | A | 1/2018 |
| KR | 10-1812775 | B1 | 1/2018 |
| KR | 10-2019-0070550 | A | 6/2019 |
| KR | 10-2019-0076267 | A | 7/2019 |
| KR | 10-2055119 | B1 | 12/2019 |
| KR | 10-2061463 | B1 | 12/2019 |
| KR | 10-2064376 | B1 | 2/2020 |
| KR | 10-2125472 | B1 | 6/2020 |
| KR | 10-2020-0127835 | A | 11/2020 |
| KR | 10-2021-0128150 | A | 10/2021 |
| WO | WO 2017/143815 | A1 | 8/2017 |

* cited by examiner

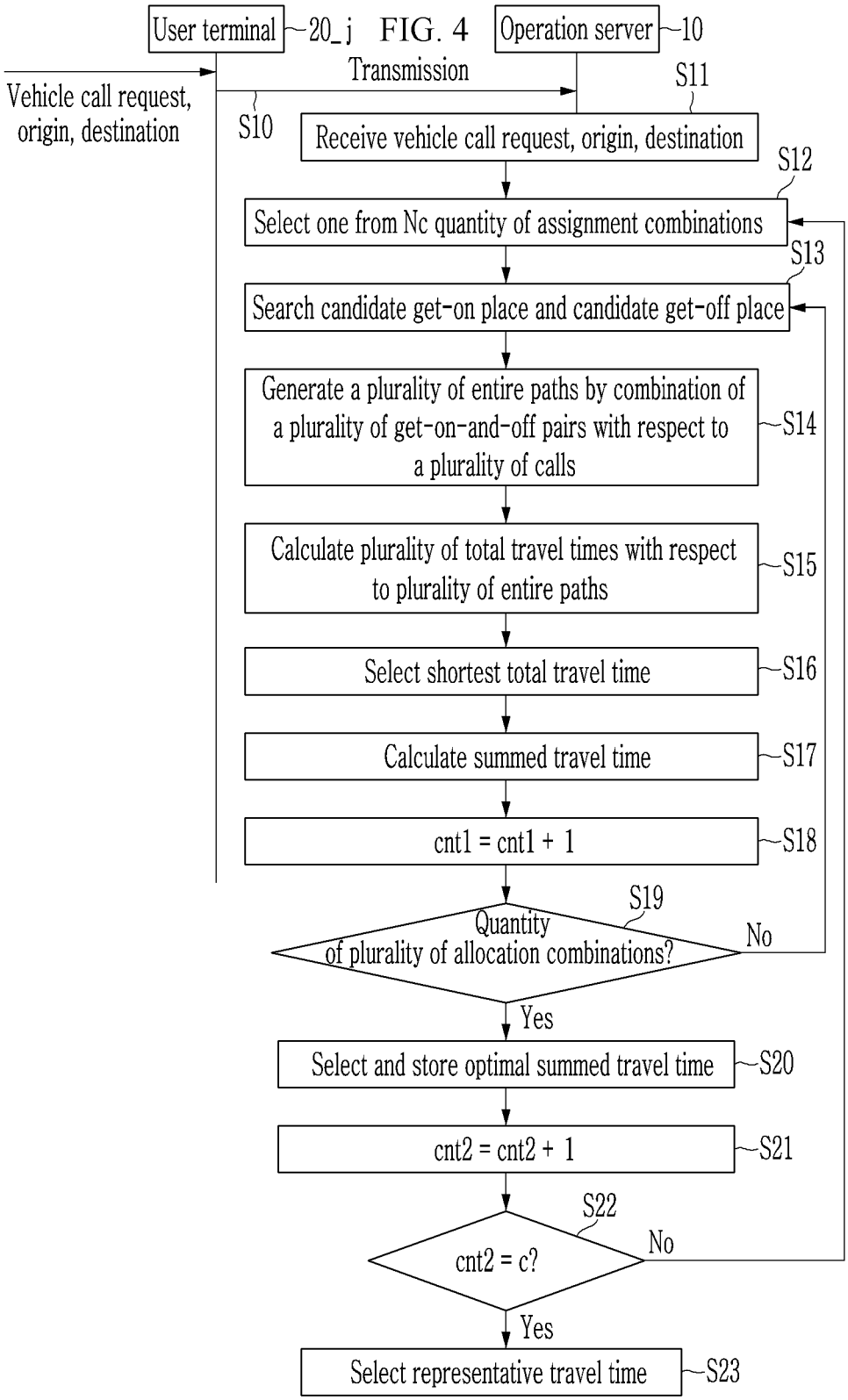
User terminal
20_j
FIG. 4
Operation server
10
Transmission
Vehicle call request, origin, destination
S10
S11
Receive vehicle call request, origin, destination
S12
Select one from Nc quantity of assignment combinations
S13
Search candidate get-on place and candidate get-off place
Generate a plurality of entire paths by combination of a plurality of get-on-and-off pairs with respect to a plurality of calls
S14
Calculate plurality of total travel times with respect to plurality of entire paths
S15
Select shortest total travel time
S16
Calculate summed travel time
S17
cnt1 = cnt1 + 1
S18
S19
Quantity of plurality of allocation combinations?
No
Yes
Select and store optimal summed travel time
S20
cnt2 = cnt2 + 1
S21
S22
cnt2 = c?
No
Yes
Select representative travel time
S23

METHOD FOR DETERMINING VEHICLE PARKING PLACE AND OPERATION SERVER UTILIZING THE SAME

CROSS-REFERENCE TO RELATED APPLICATION

The present application claims priority to Korean Patent Application No. 10-2020-0161464 filed on Nov. 26, 2020, the entire contents of which is incorporated herein for all purposes by this reference.

BACKGROUND OF THE INVENTION

Field of the Invention

The present invention relates to a method for determining a vehicle parking place and an operation server utilizing the same.

Description of Related Art

In the ridesharing service, vehicles that have finished running are parked in the parking place. Places where the vehicle may be parked are preset as the parking places, and the number and positions of parking places are determined according to the circumstances of the service area. As a matter of fact, the number of parking places is not large, and the locations may be positioned at a considerable distance from a vehicle call location.

If a vehicle having received a call needs to move a significant distance from the parking place to the origin of the passenger, the travel time and cost may increase due to the increase in the vehicle travel distance. Furthermore, the number of vehicles which may be parked is limited in the parking place, and the vehicle currently parked may be in the corresponding parking place. That is, if determining a parking place for a vehicle that has finished running is simply determined to be a parking place close to a current position of the vehicle, there may be a problem that the vehicle cannot use the determined parking place, or that the vehicle must move a considerable distance for a next run.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a method for determining a vehicle parking place and an operation server utilizing the same.

An exemplary method for operating a parking place based on demand expectation, may include expecting n quantity of calls corresponding to a current time in a service area, deriving Nc quantity of assignment combinations that assign Nb quantity of vehicles in standby in the service area with respect to Na quantity of parking places positioned in the service area, with respect to each in the Nc quantity of assignment combination, allocating the expected n quantity of calls to Nd quantity of vehicles in the service area including the Nb quantity of vehicles, and deriving Nd quantity of total travel times of the Nd quantity of vehicles, and assigning a corresponding parking place from among the Na quantity of parking places to each in the Nb quantity of vehicles based on the Nd quantity of total travel times with respect to each in the Nc quantity of assignment combination.

The assigning of the corresponding parking place from among the Na quantity of parking places to each in the Nb quantity of vehicles may include determining Nc quantity of representative travel times according to a sum of the Nd quantity of total travel times, with respect to the Nc quantity of assignment combinations, and assigning a corresponding parking place from among the Na quantity of parking places to each in the Nb quantity of vehicles according to a shortest representative travel time among the Nc quantity of representative travel times.

The deriving of the Nd quantity of total travel times may include generating a plurality of allocation combinations that allocate the expected n quantity of calls to the Nd quantity of vehicles, with respect to one among the Nc quantity of assignment combinations, and determining the total travel time of each in the Nd quantity of vehicles with respect to each in the plurality of allocation combinations.

The determining of the Nc quantity of representative travel times may include determining a summed travel time by summing the determined total travel times of the Nd quantity of vehicles, with respect to each in the plurality of allocation combinations, and selecting a shortest summed travel time among a plurality of summed travel times with respect to the plurality of allocation combinations as the representative travel time.

In the determining of the summed travel time, in determining the total travel times for the Nb quantity of vehicles, a time required for each in the Nb quantity of vehicles to move from a current position to the assigned parking place among the Na quantity of parking places according to the Nc quantity of assignment combinations may be included in the total travel time.

The determining of the summed travel time by summing the total travel times of the Nd quantity of vehicles may include allocating a plurality of passengers according to one among the plurality of allocation combinations, with respect to each in the Nd quantity of vehicles, generating a plurality of entire paths for the allocated plurality of passengers, with respect to each in the Nd quantity of vehicles, determining a plurality of total travel times with respect to the plurality of entire paths, with respect to each in the Nd quantity of vehicles, and selecting a shortest total travel time among the plurality of total travel times, with respect to each in the Nd quantity of vehicles.

The determining of the plurality of total travel times may include, with respect to each in a plurality of passengers allocated to each in the d quantity of vehicles, setting a plurality of candidate get-on places within a predetermined distance from an origin and a plurality of candidate get-off places within a predetermined distance from a destination, generating a plurality of get-on-and-off pairs by combination of the plurality of candidate get-on places and the plurality of candidate get-off places, generating a plurality of entire paths available obtainable by selecting one among the plurality of get-on-and-off pairs, and determining the plurality of total travel times with respect to the plurality of entire paths.

The determining of the plurality of total travel times may include, with respect to each in the plurality of entire paths, determining a passenger moving time based on a pre-get-on walking time from the origin to a candidate get-on place, a post-get-off walking time from a candidate get-off place to the destination, and a vehicle travel time required for one vehicle among the Nd quantity of vehicles to travel from the candidate get-on place to the candidate get-off place, determining a vehicle running time according to a cost for the one vehicle to travel through the candidate get-on place and the candidate get-off place, and determining the total travel time by summing the passenger moving time and the vehicle running time. In the determining of the vehicle running time, the vehicle may be one among the Nb quantity of vehicles, and a time for the vehicle to move from a current position to the assigned parking place among the Na quantity of parking places may be included in the total travel time.

An exemplary method may further include monitoring whether a standby vehicle that has finished running occurs among the Nd quantity of vehicles. The expecting of the n quantity of calls may be performed when the standby vehicle occurs.

The expecting n quantity of calls may include deriving the expected demand at the current time by sampling a predetermined quantity of data from call data of a predetermined time period including the current time among an accumulated service call data.

The deriving of the Nc quantity of assignment combinations may include generating the Nc quantity of assignment combinations by assigning the Nb quantity of vehicles to each in the Na quantity of parking places while allowing overlapping as many as a number of vehicles to be parked.

The deriving of the Nc quantity of assignment combinations may include assigning, when a currently parked vehicle exists in one among the Na quantity of parking places, a remaining number of vehicles excluding the currently parked vehicle from a number of vehicles to be parked in the corresponding parking place, among the Nb quantity of vehicles.

An exemplary method may further include assigning, when there exists a first vehicle positioned within a threshold distance range with respect to a first parking place among the Na quantity of parking places among the Nb quantity of vehicles, the first vehicle to the first parking place. The parking place may be assigned with respect to remaining vehicles excluding the first vehicle among the Nb quantity of vehicles.

An exemplary operation server providing a transportation service upon receiving an origin and a destination along with a vehicle call request from a user terminal may include a demand expectation module configured to expect n quantity of calls corresponding to a current time in a service area, a vehicle assignment module configured to derive Nc quantity of assignment combinations that assign Nb quantity of vehicles in standby in the service area with respect to Na quantity of parking places positioned in the service area, a vehicle allocation module configured to allocate the expected n quantity of calls to Nd quantity of vehicles in the service area including the Nb quantity of vehicles according to a plurality of allocation combinations, with respect to each in the Nc quantity of assignment combination, and a total travel time calculation module configured to determine a plurality of total travel times with respect to a plurality of entire paths of each in the Nd quantity of vehicles, with respect to each in the plurality of allocation combinations. The vehicle assignment module may be configured to assign a corresponding parking place from among the Na quantity of parking places to each in the Nb quantity of vehicles based on the Nd quantity of total travel times with respect to each in the Nc quantity of assignment combination.

The vehicle assignment module may be configured to, select an optimal summed travel time based on the Nd quantity of total travel times with respect to each in the Nc quantity of assignment combination, and assign a corresponding parking place from among the Na quantity of parking places to each in the Nb quantity of vehicles according to a shortest representative travel time among Nc quantity of optimal summed travel times with respect to Nc quantity of assignment combinations.

The vehicle allocation module may be configured to, generate the plurality of allocation combinations that allocate the expected n quantity of calls to the Nd quantity of vehicles, with respect to one among the Nc quantity of assignment combinations, select a shortest total travel time from among the determined plurality of total travel times of each in the Nd quantity of vehicles, determine a summed travel time by summing the shortest total travel time of each in the Nd quantity of vehicles, select a shortest summed travel time among a plurality of summed travel times with respect to the plurality of allocation combinations as the representative travel time, select a representative travel time with respect to each in the Nc quantity of assignment combination, and select a shortest one among Nc quantity of representative travel times with respect to the Nc quantity of assignment combinations as a representative travel time.

An exemplary operation server may further include an entire path generation module configured to generate a plurality of entire paths for a plurality of passengers according to one among the plurality of allocation combinations, with respect to with respect to each in the Nd quantity of vehicles. The total travel time calculation module may determine the plurality of total travel times with respect to the plurality of entire paths, with respect to each in the Nd quantity of vehicles.

The entire path generation module may be configured to, with respect to each of a plurality of passengers allocated to each in the Nd quantity of vehicles, set a plurality of candidate get-on places within a predetermined distance from the origin and a plurality of candidate get-off places within a predetermined distance from the destination, generate a plurality of get-on-and-off pairs by combination of the plurality of candidate get-on places and the plurality of candidate get-off places, and generate a plurality of entire paths available obtainable by selecting one among the plurality of get-on-and-off pairs.

An exemplary operation server may further include a passenger moving time calculation module configured to determine a passenger moving time based on a pre-get-on walking time from the origin to a candidate get-on place, a post-get-off walking time from a candidate get-off place to the destination, and a vehicle travel time required for one vehicle among the Nd quantity of vehicles to travel from the candidate get-on place to the candidate get-off place, with respect to each in the plurality of entire paths.

An exemplary operation server may further include a vehicle running time calculation module configured to determine a vehicle running time according to a cost for the one vehicle to travel through the candidate get-on place and the candidate get-off place. The vehicle running time calculation module may be configured to, when the vehicle is one of the Nb quantity of vehicles, determine the vehicle running time to include a time for the vehicle to move from a current position to the assigned parking place among the Na quantity of parking places.

The total travel time calculation module may be configured to determine the total travel time by adding a passenger moving time and the vehicle running time with respect to each in the plurality of entire paths, with respect to with respect to each in the Nd quantity of vehicles.

The demand expectation module may be configured to derive an expected demand at the current time by sampling a predetermined quantity of data from call data of a predetermined time period including the current time among an accumulated service call data.

The vehicle assignment module may be configured to generate the Nc quantity of assignment combinations by assigning the Nb quantity of vehicles to each in the Na quantity of parking places while allowing overlapping as many as a number of vehicles to be parked.

The vehicle assignment module may be configured to, when a currently parked vehicle exists in one among the Na quantity of parking places, assign a remaining number of vehicles excluding the currently parked vehicle from a number of vehicles to be parked in the corresponding parking place, among the Nb quantity of vehicles.

An exemplary operation server may further include a monitoring module configured to monitor whether a standby vehicle that has finished running occurs among the Nd quantity of vehicles. The monitoring module may be configured to, when the standby vehicle occurs, transmit information on the standby vehicle to the demand expectation module.

The total travel time calculation module may be configured to, in determining the total travel times for the Nb quantity of vehicles, determine the total travel time to include a time required for each in the Nb quantity of vehicles to move from a current position to the assigned parking place among the Na quantity of parking places.

The operation server may be configured to, when there exists a first vehicle positioned within a threshold distance range with respect to a first parking place among the Na quantity of parking places among the Nb quantity of vehicles, assign the first vehicle to the first parking place, and assign the parking place with respect to remaining vehicles excluding the first vehicle among the Nb quantity of vehicles.

An exemplary method for operating a parking place based on demand expectation, may include expecting n quantity of calls corresponding to a current time in a service area, deriving Nc quantity of assignment combinations that assign Nb quantity of vehicles in standby in the service area with respect to Na quantity of parking places positioned in the service area, allocating the expected n quantity of calls to the Nb quantity of vehicles and deriving Nb quantity of total travel times of the Nb quantity of vehicles, with respect to each in the Nc quantity of assignment combination, and assigning a corresponding parking place from among the Na quantity of parking places to each in the Nb quantity of vehicles based on the Nb quantity of total travel times with respect to each in the Nc quantity of assignment combination.

The assigning of the corresponding parking place from among the Na quantity of parking places to each in the Nb quantity of vehicles may include determining Nc quantity of optimal summed travel times based on a sum of the Nb quantity of total travel times, with respect to the Nc quantity of assignment combinations, and assigning a corresponding parking place from among the Na quantity of parking places to each in the Nb quantity of vehicles according to a shortest representative travel time among the Nc quantity of optimal summed travel times.

The deriving of the Nb quantity of total travel times may include generating a plurality of allocation combinations that allocate the expected n quantity of calls to the Nb quantity of vehicles, with respect to one among the Nc quantity of assignment combinations, and determining a total travel time of each in the Nb quantity of vehicles with respect to each in the plurality of allocation combinations.

The determining of the Nc quantity of optimal summed travel times may include determining a summed travel time by summing the determined total travel times of the Nb quantity of vehicles with respect to each in the plurality of allocation combinations, and selecting a shortest summed travel time among a plurality of summed travel times with respect to the plurality of allocation combinations, as an optimal summed travel time.

An exemplary method may further include assigning, when there exists a first vehicle positioned within a threshold distance range with respect to a first parking place among the Na quantity of parking places among the Nb quantity of vehicles, the first vehicle to the first parking place. The parking place may be assigned with respect to remaining vehicles excluding the first vehicle among the Nb quantity of vehicles.

Various aspects of the present invention provide a method for determining a vehicle parking place and an operation server utilizing the same.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 3, FIG. 4 and to FIG. 5 are respectively a flowchart showing a method for assigning a standby vehicle to a parking place according to an exemplary embodiment of the present invention.

Figure 1:
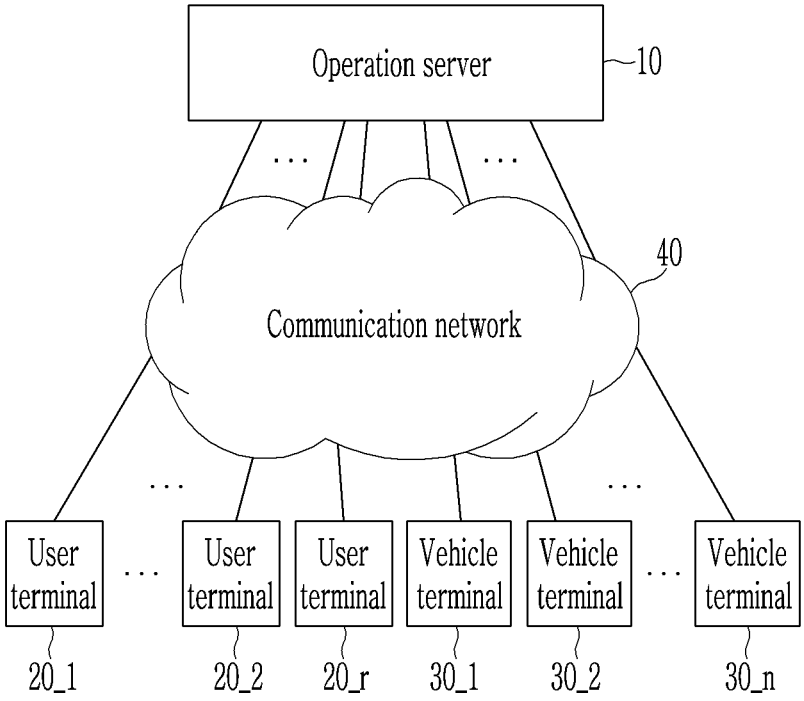
FIG. 1 illustrates a passenger transportation service system according to an exemplary embodiment of the present invention.

It may be understood that the appended drawings are not necessarily to scale, presenting a somewhat simplified representation of various features illustrative of the basic principles of the invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments of the present invention, it will be understood that the present description is not intended to limit the invention(s) to those exemplary embodiments. On the other hand, the invention(s) is/are intended to cover not only the exemplary embodiments of the present invention, but also various alternatives, modifications, equivalents and other embodiments, which may be included within the spirit and scope of the invention as defined by the appended claims.

Hereinafter, various exemplary embodiments disclosed in the present specification will be described in detail with reference to the accompanying drawings. In the present specification, the same or similar components will be denoted by the same or similar reference numerals, and a repeated description thereof will be omitted. Terms "module" and/or "unit" for components used in the following description are used only to easily describe the specification. Therefore, these terms do not have meanings or roles that distinguish them from each other in and of themselves. In describing exemplary embodiments of the present specification, when it is determined that a detailed description of the well-known art associated with the present invention may obscure the gist of the present invention, it will be omitted. The accompanying drawings are provided only to allow exemplary embodiments disclosed in the present specification to be easily understood and are not to be interpreted as limiting the spirit disclosed in the present specification, and it is to be understood that the present invention includes all modifications, equivalents, and substitutions without departing from the scope and spirit of the present invention.

Terms including ordinal numbers such as first, second, and the like will be used only to describe various components, and are not to be interpreted as limiting these components. The terms are only used to differentiate one component from other components.

It is to be understood that when one component is referred to as being "connected" or "coupled" to another component, it may be connected or coupled directly to the other component or may be connected or coupled to the other component with a further component intervening therebetween. Furthermore, it is to be understood that when one component is referred to as being "directly connected" or "directly coupled" to another component, it may be connected or coupled directly to the other component without a further component intervening therebetween.

It will be further understood that terms "comprise" and "have" used in the exemplary embodiment specify the presence of stated features, numerals, steps, operations, components, portions, or combinations thereof, but do not preclude the presence or addition of one or more other features, numerals, steps, operations, components, portions, or combinations thereof.

Furthermore, the terms "-er", "-or", and "module" described in the specification mean units for processing at least one function and operation, and may be implemented by hardware components or software components, and combinations thereof.

FIG. 1 illustrates a passenger transportation service system according to an exemplary embodiment of the present invention.

A passenger transportation service system 1 includes an operation server 10, user terminals 20_1 to **20_*r*, and vehicle terminals 30_1 to 30_*n***. Here, r and n are natural numbers greater than or equal to 1.

Each of the vehicles providing the passenger transportation service is provided with a vehicle terminal, and FIG. 1 illustrates that n vehicles are providing the passenger transportation service, and r user terminals may generate a vehicle call request, i.e., a request for calling a vehicle. Hereinafter, for convenience of description, when a feature applicable to any user terminal is described, the user terminal is referred to by the reference numeral 20, and when a feature applicable to any vehicle terminal, the vehicle terminal is referred to by the reference numeral 30, while the reference numeral **20_*j* is used to indicate a specific user terminal and the reference numeral 30_*i* or the reference numeral 30_*p* is used to indicate a specific vehicle terminal Transmission and reception of information between the user terminal 20 and the operation server 10 and transmission and reception of information between the vehicle terminal 30 and the operation server 10 may be conducted through a communication network 40**.

A user (hereinafter, also called a passenger) willing to use the passenger transportation service may input information associated to a destination and position information related to the user into the user terminal 20, and the user terminal 20 may transmit the input data to the operation server 10. The position information related to the user may be based on a currently recognized position utilizing a global positioning system (GPS) of the user terminal 20. Alternatively, the position information related to the user may be information associated with a position which the user specifies through the user terminal 20.

The user terminal 20 may be inputted with a vehicle call, a destination, and an origin from the passenger, and may transmit the destination and the origin together with notification of the vehicle call to the operation server 10. The origin may be a current position of the user terminal 20, and the current position may be recognized using the Global Positioning System (GPS) of the user terminal 20. Furthermore, the user terminal 20 may transmit the number of passengers, etc., along with the origin and the destination to the operation server 10.

The user terminal 20 may receive information related to a get-on place and a get-off place from the operation server 10. The user terminal 20 may receive information from the operation server 10, such as a vehicle identification number, a vehicle driver's contact information, an expected arrival time of the vehicle to the get-on place (hereinafter, an expected get-on time), an expected arrival time of the vehicle to the get-off place (hereinafter, an expected get-off time), etc., along with the get-on place and the get-off place.

The user terminal 20 may receive charging information for a transportation service fare from the operation server 10 and pay the fare based on the charging information. The user terminal 20 may receive identification information for identifying a passenger from the operation server 10 through the communication network 40, and may display the identification information on a display of the user terminal 20.

The user terminal 20 may be a smart phone, a laptop, a tablet PC, etc., and an application to use the passenger transportation service may be installed in the user terminal 20. The user terminal 20 may perform the aforementioned operations through the installed application.

The vehicle terminal 30 is installed in each of the vehicles used in the passenger transportation service. The vehicle terminal 30 may transmit a current position of the vehicle to the operation server 10 in real time, and may receive, from the operation server 10, information related to the get-on place and the get-off place with respect to each passenger to use the vehicle and information related to an expected get-on time for each get-on place and an expected get-off time for each get-off place. The vehicle terminal 30 may also receive an identification information for each passenger to use the vehicle from the operation server 10

The identification information for each passenger may be transmitted from the operation server 10 to both of the user terminal 20 of each passenger and the vehicle terminal 30 of the vehicle to be used by each passenger.

The vehicle terminal 30 may be a smart phone, a laptop, a tablet PC, etc., and an application for providing the passenger transportation service may be installed in the vehicle terminal 30. The vehicle terminal 30 may perform the aforementioned operations through the installed application.

The operation server 10 receives information for the origin and the destination from the user terminal 20, and selects, among vehicles configured for providing the passenger transportation service, a vehicle to pass through the get-on place corresponding to the origin received from the user terminal 10 and the get-off place corresponding to the destination.

The operation server 10 may transmit the get-on place and the get-off place, the expected get-on time and the expected get-off time, and passenger identification information, to the vehicle terminal 30_*i* (here, i is a natural number from in 1 to n) of the selected vehicle, and to the user terminal 20_*j* (here, j is a natural number from 1 to r) that requested the vehicle call. Furthermore, the operation server 10 may further transmit the vehicle identification number, the vehicle driver's contact information, charging information to the user terminal 20_*j*, and the like.

The operation server 10 may reflect expected demand corresponding to a current time within the service area, in assigning a parking place to a standby vehicle, i.e., a vehicle which is not running.

Furthermore, the user terminal 20 may further perform an operation required to request the passenger transportation service, if applicable. The vehicle terminal 30 may further perform an operation required to provide the passenger transportation service, if applicable. The operation server 10 may provide a further service to the user terminal 20 or the vehicle terminal 30, if applicable. The content described in various exemplary embodiments of the present invention does not limit the application of the technology not described to the present invention. That is, a new service may be provided by combining the present invention with currently known technologies, and the contents described in various exemplary embodiments of the present invention do not limit such variation.

Figure 2:
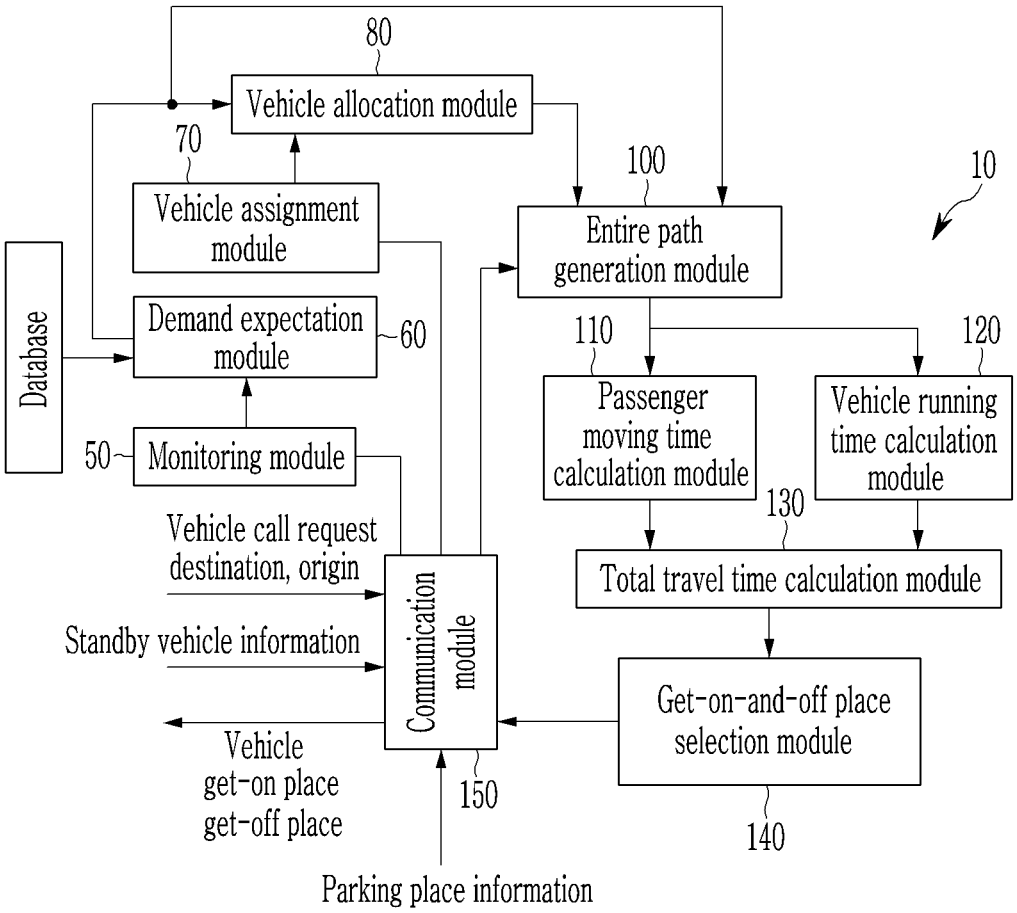
FIG. 2 schematically illustrates an operation server according to an exemplary embodiment of the present invention.

FIG. 2 schematically illustrates an operation server according to an exemplary embodiment of the present invention.

Figure 3:
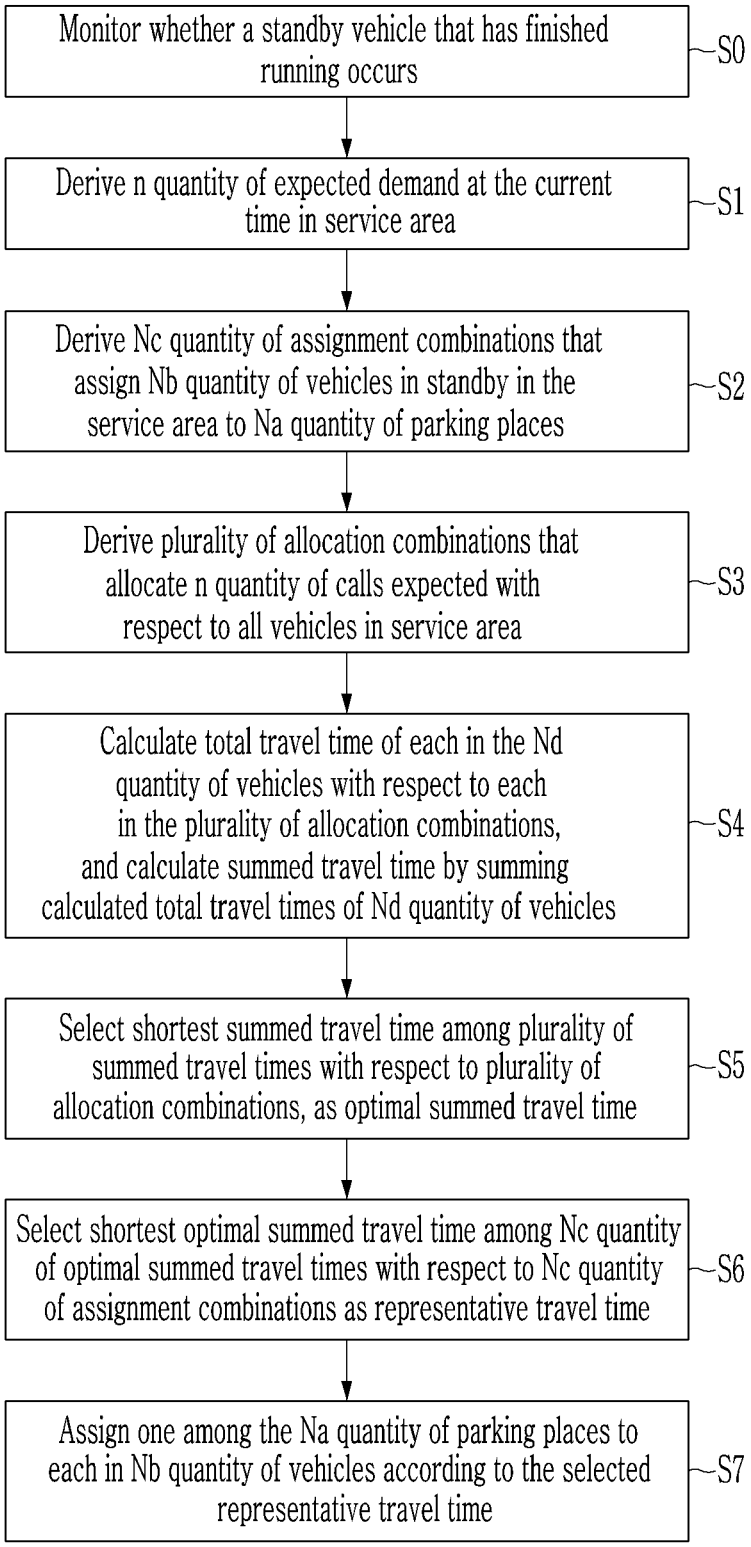
Figure 5:
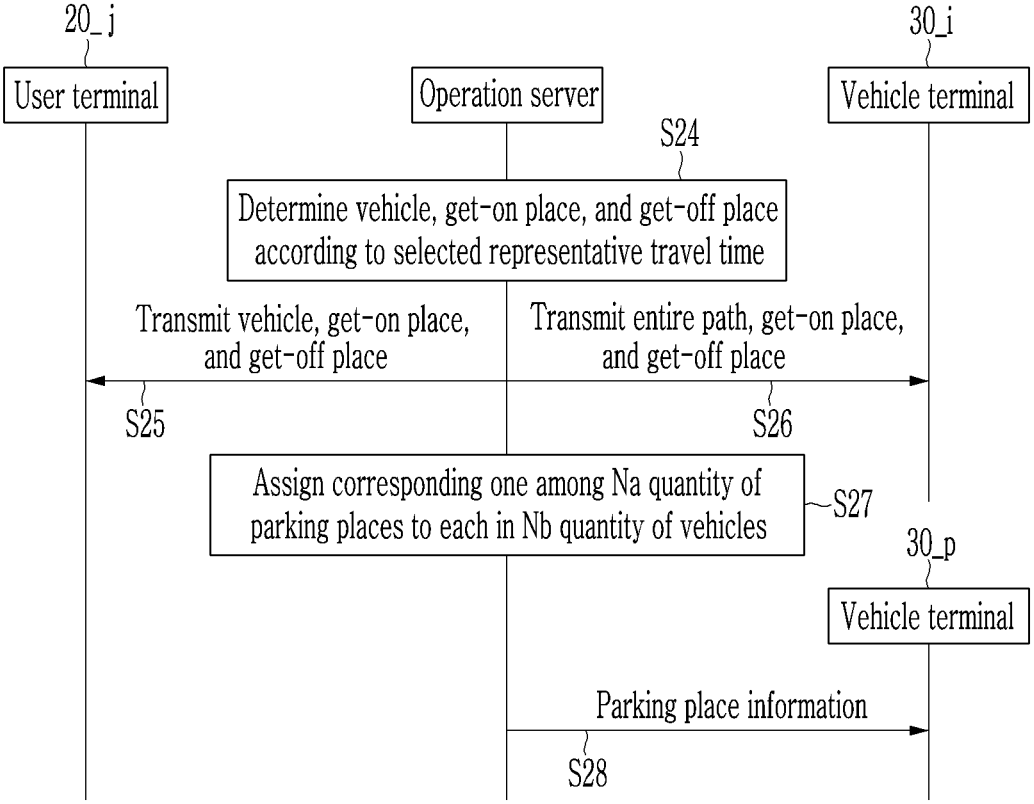

FIG. 3, FIG. 4 and to FIG. 5 are respectively a flowchart showing a method for assigning a standby vehicle to a parking place according to an exemplary embodiment of the present invention.

Figure 6:
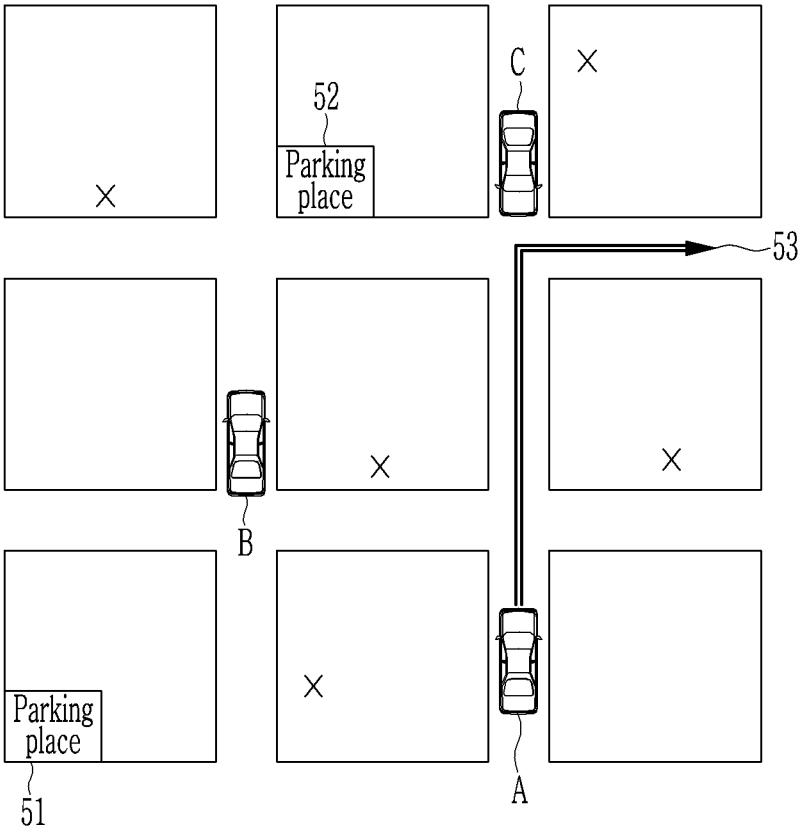
FIG. 6 schematically illustrates a method for assigning a standby vehicle to a parking place according to an exemplary embodiment of the present invention.

FIG. 6 schematically illustrates a method for assigning a standby vehicle to a parking place according to an exemplary embodiment of the present invention.

As shown in FIG. 2, the operation server 10 includes a monitoring module 50, a demand expectation module 60, a vehicle assignment module 70, a vehicle allocation module 80, a database, an entire path generation module 100, a passenger moving time calculation module 110, a vehicle running time calculation module 120, a total travel time calculation module 130, a get-on-and-off place selection module 140, and a communication module 150.

Referring to FIG. 3, at step S0, the monitoring module 50 monitors whether a standby vehicle that has finished running occurs. The monitoring module 50 may obtain standby vehicle information received from the vehicle terminal 30 through the communication module 150. When the standby vehicle occurs during monitoring, the monitoring module 50 proceeds to determine which parking place the corresponding vehicle is assigned to in the service area. For example, as shown in FIG. 6, vehicles B and C are vehicles that have finished running, and vehicle A is a vehicle under operation according to a path indicated by arrow 53. Accordingly, the vehicle terminals of each of vehicles B and C may transmit information indicating being the standby vehicle to the communication module 150.

At step S1, the demand expectation module 60 derives the expected demand at the current time in the service area (e.g., quantity of calls n, where n is natural number greater than or equal to 1), by use of accumulated service call data. The demand expectation module 60 may receive information from the monitoring module 50 indicating how many of standby vehicles have occurred. The demand expectation module 60 may derive the expected demand at the current time by sampling a predetermined quantity of data from call data of a predetermined time period including the current time among the accumulated service call data. The predetermined quantity may be a predetermined constant. For example, as shown in FIG. 6, the expected demand corresponding to five positions marked with "x" at the current time may be derived.

When there is not an expected demand, the operation server 10 may assign the parking place to which the travel time for the standby vehicle is shortest from the current position to the standby vehicle. The database may store the accumulated service call data.

At step S2, the vehicle assignment module 70 derives Nc (natural number greater than or equal to 1) quantity of assignment combinations that assign Nb (natural number greater than or equal to 1) quantity of vehicles in standby in the service area to Na (natural number greater than or equal to 1) quantity of parking places positioned in the service area. At the instant time, the Nb quantity of vehicles means vehicles that have finished running and to be parked at the Na quantity of parking places. The vehicle assignment module 70 may receive parking place information including information on the number of vehicles which may be parked in each parking place, the number of vehicles currently parked in each parking place, the position of each parking place, and the like, through the communication module 150. The parking place is a place providing parking of a vehicle, and may be positioned within the service area. For example, as shown in FIG. 6, two parking places 51 and 52 are positioned in the service area, and assignment combinations with respect to the vehicles B and C such as B-51, and C-51, B-51, and C-52, B-52, and C-51, B-52, and C-52 may be derived. That is, each vehicle may be assigned with the parking place while allowing overlapping as many as the number of vehicles which may be parked in the parking place. However, in the case that the number of vehicles which may be parked in the parking places 51 and 52 is smaller than the number of vehicles currently positioned in the service area, the number of vehicles which may be assigned to the parking places 51 and 52 is limited by the number of vehicles which may be parked. In the case that either one of the parking places 51 and 52 allows only one vehicle to be parked, an assignment combination to park two vehicles B and C to that parking place is excluded.

Furthermore, when there is a vehicle currently parked in the parking place, the vehicle assignment module 70 may generate the assignment combinations that assign the vehicles as many as the number obtained by subtracting the number of the currently parked vehicle from the number of vehicles which may be parked in that parking place. For example, in FIG. 6, if the number of vehicles which may be parked in parking place 51 is 2 and one vehicle is already parked, the number of vehicles which may be parked in the parking place 51 remains only 1, and thus, the combinations of B-51 and C-51 in the above example are excluded.

At step S3, when receiving the expected demand from the demand expectation module 60, and receiving Nc quantity of assignment combinations from the vehicle assignment module 70, the vehicle allocation module 80 generates a plurality of allocation combinations that allocate n quantity of calls expected with respect to all vehicles in the service area, with respect to one among the Nc quantity of assignment combinations. The vehicle allocation module 80 may receive the derived expected demand at the current time from the demand expectation module 60. At the instant time, all vehicles in the service area includes the Nb quantity of vehicles to which the parking place will be allocated, and for convenience of description, the number of all vehicles in the service area may be Nd (a natural number greater than or equal to 1). All of the Nd quantity of vehicles in the service area means all operable vehicles which may provide ride-sharing service. Therefore, among all vehicles for the ride-sharing service, vehicles that do not operate due to reasons such as vehicle inspection, suspension, and the like are excluded. For example, all combinations that allocate five expected demand shown in FIG. 6 to the vehicles A, B, and C may be derived. Accordingly, the total number of cases may be a value $3^5$ obtained by exponentially multiplying the number of vehicles positioned in the service area by the expected demand.

At step S4, the operation server 10 determines the total travel time of each in a Nd quantity of vehicles with respect to each in the plurality of allocation combinations, and determines a summed travel time by summing the determined total travel times of the Nd quantity of vehicles. In determining the total travel times for the Nb quantity of vehicles by the operation server 10, the time required for each in the Nb quantity of vehicles to move from the current position to the assigned parking place among the Na quantity of parking places according to one among the Nc quantity of assignment combinations is disposed in the total travel times.

At step S5, the operation server 10 may select a shortest summed travel time among a plurality of summed travel times with respect to the plurality of allocation combinations, as the optimal summed travel time.

At step S6, the operation server 10 may select the optimal summed travel time with respect to each in the Nc quantity of assignment combinations, and may select a shortest one among Nc quantity of optimal summed travel times with respect to the Nc quantity of assignment combinations, as a representative travel time.

At step S7, the operation server 10 may assign one among the Na quantity of parking places to each in the Nb quantity of vehicles according to the selected representative travel time.

Hereinafter, the steps S3 to S7 together with a configuration of the operation server 10 are described in detail with reference to FIG. 4 and FIG. 5.

First at step S10, the user terminal 20 receives the vehicle call request from the passenger along with the origin and the destination, and transmits the vehicle call request to the operation server 10 along with information for the origin and the destination.

Subsequently at step S11, the communication module 150 of the operation server 10 receives the origin, the destination, and the vehicle call request from the user terminal 20.

At step S12, the operation server 10 selects one among the Nc quantity of assignment combinations. Accordingly, the operation server 10 proceeds to determine an optimal summed travel time with respect to the assignment combination selected at the step S12.

At step S13, the entire path generation module 100 searches for candidate get-on places and candidate get-off places for get-on and get-off around a plurality of origins and a plurality of destinations, based on each call allocated to each vehicle according to one among the plurality of allocation combinations with respect to the Nd quantity of vehicles. The entire path generation module 100 may receive the plurality of allocation combinations based on the assignment combination selected at the step S12 from the vehicle allocation module 80, may receive information on the origin and the destination of each of the expected demand from the demand expectation module 60, and may receive the origin, the destination, and the vehicle call request from the user terminal 20 through the communication module 150. Therefore, the plurality of origins the plurality of destinations from which the entire path generation module 100 searches the candidate get-on-and-off places includes the origin and the destination received from the user terminal 20 and the origin and the destination of each of the expected demands received from the demand expectation module 60.

The entire path generation module 100 may search for the candidate get-on place within a predetermined distance from the origin based on a straight-line distance, a walking distance, a walking time, and the like from the origin to candidate get-on-and-off place, and may search for the candidate get-off place within a predetermined distance with respect to the destination based on a straight-line distance, a walking distance, a walking time, and the like to the destination. The operation server 10 may preset the candidate get-on-and-off places for every point of the service area for the transportation service, in consideration of distances from each point to get-on-and-off points where the vehicle may stop. Among a plurality of candidate get-on-and-off places, the operation server 10 finds the candidate get-on-and-off places close to the origin as the candidate get-on places, and finds the candidate get-on-and-off places close to the destination as the candidate get-on places.

At step S14, with respect to the Nd quantity of vehicles, the entire path generation module 100 generates a plurality of get-on-and-off pairs by combining each in a plurality of candidate get-on places and each in a plurality of candidate get-off places corresponding to each call allocated to each vehicle, and generates the entire path by combination of the plurality of get-on-and-off pairs with respect to a plurality of calls allocated to each vehicle. When there are two or more calls, the entire path generation module 100 generates the plurality of get-on-and-off pairs for each call, selects one among the plurality of get-on-and-off pairs of each call, and generates entire paths for the plurality of calls. The entire path generation module 100 generates a plurality of entire paths for all combinations available by selecting one from the plurality of get-on-and-off pairs for each in the plurality of calls.

The operation server 10 determines a plurality of total travel times for the plurality of entire paths of each vehicle, with respect to the Nd quantity of vehicles. The total travel time may be determined in consideration of a first walking distance from the origin to the candidate get-on place, a second walking distance from the candidate get-off place to the destination, a first walking time required to walk the first walking distance, a second walking time required to walk the second walking distance, a vehicle travel time for the vehicle to move from the origin to the destination, the passenger's preference based on the passenger's profile and the situation in which the transportation service is provided, the vehicle running time, an existing passenger's detour cost in the case that shared ride is available, and the like.

At step S15, the passenger moving time calculation module 110 determine a passenger moving time for each in the plurality of entire paths of each vehicle with respect to the Nd quantity of vehicles. The passenger moving time calculation module 110 determines a plurality of passenger moving times for all the plurality of entire paths by use of map information and traffic situation information, and the like. The passenger moving time includes the first walking distance from the origin to the candidate get-on place, the second walking distance from the candidate get-off place to the destination, the first walking time required to walk the first walking distance, the second walking time required to walk the second walking distance, and the vehicle travel time from the candidate get-on place to the candidate get-off place.

With respect to the Nd quantity of vehicles, the passenger moving time calculation module 110 determines the passenger moving time with respect to each in the plurality of calls, and determine the passenger moving time with respect to one entire path by summing the plurality of passenger moving times with respect to the plurality of calls, according to one from the plurality of entire paths for each vehicle.

With respect to the Nd quantity of vehicles, the vehicle running time calculation module 120 determines the vehicle running time in consideration of the total travel time, fuel cost, and the like of the vehicle for each in the plurality of entire paths of each vehicle. The vehicle running time corresponds to a running cost of the vehicle, and the vehicle running time calculation module 120 may generate the vehicle running time by converting the vehicle running cost for each in the plurality of entire paths to time. At the instant time, when the corresponding vehicle is a vehicle assigned to the parking place, the vehicle running time calculation module 120 determines the vehicle running time to include a time corresponding to a vehicle running cost required to move from the current position of the vehicle to the parking place according to one among the Nc quantity of assignment combinations determined at the step S3.

The vehicle running time calculation module 120 may determine a plurality of vehicle running times with respect to all of the plurality of entire paths of each vehicle, with respect to the Nd quantity of vehicles. For example, the vehicle running time calculation module 120 may determine the vehicle running time by adding the total travel time for which the vehicle travels to provide the transportation service to the time converted from the fuel consumed by running of the vehicle, with respect to one of the plurality of entire paths.

In determining the total travel time, in the case that a shared ride of the vehicle is available, the operation server 10 may consider a detour time of the existing passengers and a detour time according to the detour distance, according to the addition of the candidate get-on place and the candidate get-off place. The passenger moving time calculation module 110 adds all of a plurality of vehicle travel times according to a plurality of vehicle call requests, through which the detour time of the existing passengers due to shared riding may be reflected. All the vehicle travel time for each passenger are summed in determining the passenger moving time. However, the vehicle actually travels according to the entire path, and therefore, the result of sum of all the vehicle travel time for each passenger may be different from an actual travel time for the vehicle travel to transport the passengers. That is, in the passenger moving time, there is a time overlap between the vehicle travel time for each passenger. As the number of passengers increases due to shared riding, the number of the vehicle travel times increases in determining the passenger moving time, resulting in more time overlap. Through this, the detour time, the detour distance, and the like of the existing passengers may be reflected in the passenger moving time.

With respect to the Nd quantity of vehicles, the total travel time calculation module 130 may determine the total travel time in consideration of the passenger's preference based on the passenger's profile and the situation in which the transportation service is provided along with the passenger moving time and the vehicle running time for each in the plurality of entire paths of each vehicle. The situation in which the transportation service is provided includes the day of the week, time, weather, and the like, and the passenger's profile includes the gender, age group of the passenger, and the like. For example, the total travel time calculation module 130 may set a higher preference for the candidate get-on place and the candidate get-off place which may provide a shorter walking time or availability of moving through buildings in rainy weather, and may set a higher preference for the candidate get-on place and the candidate get-off place on a wider street in the case of a female passenger during the late night. The higher the preference, the higher the weight value for the factor in determining the total travel time.

At step S16, the total travel time calculation module 130 may select a shortest total travel time from among the plurality of total travel times for the plurality of entire paths of each vehicle with respect to the Nd quantity of vehicles. The total travel time calculation module 130 includes a memory 131, and may store the plurality of total travel times with respect to the plurality of entire paths with respect to each in a plurality of vehicles in the memory 131. The total travel time calculation module 130 selects the shortest total travel time from among all the plurality of total travel times with respect to each vehicle stored in the memory 131.

At step S17, the vehicle allocation module 80 determines the summed travel time by summing the shortest total travel times with respect to the Nd quantity of vehicles, with respect to each in the plurality of allocation combinations.

By repeatedly performing the steps S13 to S17 with respect to the plurality of allocation combinations, the plurality of summed travel times for all of the plurality of allocation combinations are obtained. At step S18, the vehicle allocation module 80 increases a count value cnt1 each time the summed travel time is obtained, and at step S19, the vehicle allocation module 80 determines whether the count value cnt1 reaches the quantity of the plurality of allocation combinations.

When the count value cnt1 has not reached the quantity of the plurality of allocation combinations (S19—No), the process returns to the step S13. When the count value cnt1 has reached the quantity of the plurality of allocation combinations (S19—Yes), at step S20, the vehicle allocation module 80 stores the plurality of summed travel times for the plurality of allocation combinations, and selects and stores the shortest summed travel time among the plurality of summed travel times as the optimal summed travel time.

The vehicle allocation module 80 may include a memory 81 to store the plurality of summed travel times, the optimal summed travel time, and the like.

The steps S12 to S18 are repeatedly performed with respect to the Nc quantity of assignment combinations, and Nc quantity of the optimal summed travel times for all of the Nc quantity of assignment combinations are obtained. At step S21, the vehicle allocation module 80 increases a count value cnt2 each time the optimal summed travel time is obtained. At step S22, the vehicle allocation module 80 determines whether the count value cnt2 has reached the quantity Nc of entire assignment combinations.

When the count value cnt2 has not reached Nc (S22—No), the process returns to the step S12. When the count value cnt2 has reached Nc (S22—Yes), at step S23, the vehicle allocation module 80 stores the Nc quantity of the optimal summed travel times in the memory 81, and selects a shortest one among the stored Nc quantity of the optimal summed travel times as the representative travel time.

At step S24, the get-on-and-off place selection module 140 finally determines, a vehicle to run an entire path corresponding to the selected the representative travel time from the vehicle allocation module 80, the candidate get-on place included in the corresponding entire path, and the candidate get-off place included in the corresponding entire path, as the vehicle to transport the passenger, the get-on place for each passenger to get on the vehicle, and the get-off place for each passenger to get off the vehicle.

At step S25, the communication module 150 may transmit the vehicle determined by the get-on-and-off place selection module 140, each get-on place, and each get-off place, to each user terminal 20_*j*. Accordingly, at step S26, the communication module 150 may transmit information related to the entire path and the get-on place and get-off place for each passenger to the vehicle terminal 30_*i* of the determined vehicle.

At step S27, the vehicle assignment module 70 assigns a corresponding one among the Na quantity of parking places to each in the Nb quantity of vehicles according to the selected the representative travel time, and transmits such information to the communication module 150. At step S28, the communication module 150 may transmit information on the assigned parking place to the standby vehicle terminal 30_*p*.

The modules introduced in the operation server 10 may mean a logical portion of a program executed by the operation server 10 to perform a specific function, which may be stored in the memory the operation server 10, and may be processed by a processor of the operation server 10. Such modules may be realized as software or a combination of software. The memory of the operation server 10 stores data related to information, and may include various types of memories such as a high-speed random access memory, a magnetic disk storage device, a flash memory device, and non-volatile memory such as a non-volatile solid-state memory device, and the like.

There may be two or more passengers using the vehicle in one instance of the vehicle call. Even if two or more passengers use the vehicle through the vehicle call request received from one user terminal 20, the two or more passengers move along the same path. Therefore, the number of passengers using the vehicle through one vehicle call does not affect the passenger moving time. However, since the number of people who may ride the vehicle is limited, the number of passengers which may use the vehicle through the one vehicle call may be limited.

The number of passengers who actually get on the vehicle may not be identical to the number of the vehicle call requests. That is, the number of passengers using the vehicle by the one vehicle call request may be two or more. Hereinafter, it will be described that "passenger" and "the vehicle call request" correspond to each other 1:1. That is, although there may be several passengers who use the vehicle by one vehicle call request, the term "passenger" hereinbelow refers to one representative passenger who actually requested the vehicle call, rather than all passengers getting on the vehicle. Furthermore, each passenger is supposed to have one origin and one destination.

Hereinafter, a method for determining the total travel time by the operation server is described in detail with reference to a specific example. As described above, the total travel time is a cost with respect to one in the plurality of entire paths which may transport all passengers of a corresponding one among the plurality of allocation combinations, for each vehicle in the d quantity of vehicles, with respect to each in the Nc quantity of assignment combinations. Therefore, when the number of cases of the plurality of entire paths corresponding to one allocated combination is m, m total travel times are determined. Since a plurality of candidate get-on-and-off pairs may be different for each vehicle according to the allocation combination, the plurality of entire paths may be derived differently for each vehicle.

The entire path generation module 100 sets the plurality of get-on-and-off pairs (x_1, y_1), . . . , (x_1,y_z), . . . , (x_s, y_1), . . . , and (x_s, y_z) from combinations of the candidate get-on places (x_1, . . . , x_s) and the candidate get-off places (y_1, . . . , y_z) with respect to the passenger (call) allocated to each in the Nd quantity of vehicles according to one among the plurality of allocation combinations, where s and z are natural numbers greater than or equal to 1. In the case of two or more passengers (calls), the entire path generation module 100 may select one in the plurality of get-on-and-off pairs for each passenger (call) allocated to each in the Nd quantity of vehicles, and may generate one entire path for all passengers (calls) allocated to each vehicle by combination of the selected get-on-and-off pairs in consideration of get-on-and-off sequence for the get-on place and the get-off place of each passenger.

With respect to a vehicle, the entire path generation module 100 may select one in the plurality of get-on-and-off pairs for each in all passengers of the corresponding vehicle, and may generate the plurality of entire paths for all derivable cases in consideration of get-on-and-off sequence for the get-on place and the get-off place of each passenger. For example, although there may be e passengers allocated to the corresponding vehicle and the quantity of the plurality of get-on-and-off pairs may be different for each passenger, for convenience of the description, it is supposed that the plurality of get-on-and-off pairs with respect to each passenger is in a quantity off. Accordingly, the number of cases of all entire paths for all passengers allocated to the corresponding vehicle becomes e!*fe.

The entire path generation module 100 may perform generating of all entire paths for each in the Nd quantity of vehicles according to allocation combination, with respect to all of the Nd quantity of vehicles, and accordingly, may generate the plurality of entire paths for the Nd quantity of vehicles for one among the plurality of allocation combinations. When the allocation combination is changed, the passengers allocated to each vehicle are also changed, and the entire path generation module 100 may generate the plurality of entire paths for each allocation combination unit.

The total travel time calculation module 130 may receive the passenger moving time and the vehicle running time for each in the plurality of entire paths from the passenger moving time calculation module 110 and the vehicle running time calculation module 120, and then may determine the total travel time by use of equation 1 shown below. In equation 1, a detour cost for the shared riding passenger is not included explicitly, but such is reflected in $$\sum_{g=1}^{h} \text{passenger moving time.}$$

That is, when there exists a shared riding passenger, the entire path is changed, and an overlapping time between the vehicle travel times of all passengers increases according to the changed entire path, from which the detour cost according to the path change may be reflected.

$$\text{total travel time} = \sum_{g=1}^{h} \text{passenger moving time} + (\text{vehicle running time} * \alpha) \quad \text{[equation 1]}$$

In equation 1, h means the total number of passengers, and g is a variable indicating each in the all passengers. The vehicle running time calculation module 120 applies, to equation 1, the time to transport all passengers in the vehicle and the vehicle running time based on the cost according to each in the plurality of entire paths. That is, in various exemplary embodiments of the present invention, the vehicle running cost is converted into time according to the unit of the total travel time. Here, a is a weight value that considers the relative importance between passenger convenience and running cost reduction. For example, when the proportion of passenger convenience is relatively increased, the total travel time calculation module 130 may adjust a to be less than 1, and when the proportion of running cost reduction is relatively increased, the total travel time calculation module 130 may adjust a to be greater than 1. Furthermore, the vehicle running time calculation module 120 may adjust the a value according to an increase or decrease in fuel cost per unit time. For example, the vehicle running time calculation module 120 may increase the a value when fuel cost per unit time increases, and decrease the a value when fuel cost per unit time decreases.

The passenger moving time calculation module 110 determines the passenger moving time for each passenger by use of equation 2.

$$\text{passenger moving time} = (\text{walking time} * \beta) + \text{vehicle travel time} \quad \text{[equation 2]}$$

In equation 2, the walking time is the sum of the walking time for a passenger to walk from the origin to the candidate get-on place and the time to walk from the candidate get-off place to the destination. The vehicle travel time is the time required for a corresponding passenger to travel from the candidate get-on place to the candidate get-off place. Here, β is a weight value for walking time, which is 1 by default, but may vary depending on the situation in which the transportation service is provided. For example, on a rainy day, passengers tend to prefer get-on and get-off places closer to the origin and the destination, even if the travel time is longer. In the instant case, the passenger moving time calculation module 110 adjusts the weight value β for the walking time to a value greater than 1. Accordingly, since the total travel time relatively decreases as the walking time becomes shorter, the get-on place and the get-off place having a shorter walking time are more likely to be selected.

The passenger moving time calculation module 110 may consider the passenger's profile in determining β. For example, when a passenger is a female and utilizes a vehicle at late night, in consideration of safety, preference for the candidate get-on place and the candidate get-off place on broad street is high. At the instant time, the passenger moving time calculation module 110 may reduce β for the candidate get-on place and the candidate get-off place on the broad street.

In determining the vehicle running time of equation 2, the vehicle running time calculation module 120 may determine the vehicle running time by converting a vehicle running cost including fuel cost required for the vehicle run through a corresponding entire path, and the like, to time. At the instant time, when the corresponding vehicle is a vehicle assigned to the parking place, the vehicle running time calculation module 120 may determine the vehicle running time to include the time corresponding to the vehicle running cost required to move from the current position of the vehicle to the parking place assigned to the corresponding vehicle. Thus, a cost for the corresponding vehicle starting from the parking place to run through the entire path as well as a cost for the corresponding vehicle to move from the current position to the assigned parking place is considered, and therefore, an accurate cost required for vehicle operation may be reflected in the determination of the parking place.

The total travel time calculation module 130 determines the total travel time according to equation 1, and determines the total travel time for all cases of entire paths. Accordingly, the total travel time calculation module 130 determines the shortest total travel time among the plurality of total travel times of each in the Nd quantity of vehicles with respect to one among the plurality of allocation combinations.

The vehicle allocation module 80 may determine the summed travel time by summing the shortest total travel times with respect to the Nd quantity of vehicles, with respect to each in the plurality of allocation combinations, and may select the shortest summed travel time among all of the plurality of summed travel times for the plurality of allocation combinations as the optimal summed travel time. The optimal summed travel time determination is performed with respect to all of the Nc quantity of assignment combinations, and the vehicle allocation module 80 selects a shortest one among the Nc quantity of the optimal summed travel times as the representative travel time. The vehicle allocation module 80 determines entire paths for Nd quantity of vehicles according to the selected the representative travel time, and determines the get-on-and-off place of each in a plurality of passengers according to the entire paths.

The vehicle assignment module 70 assigns parking places to the Nb quantity of vehicles based on such selected the representative travel time.

Since the distance from and to the origin and the destination, the walking time, the situation in which the transportation service is provided, the user profile, and the like are considered in selecting get-on-and-off locations of passengers in the passenger transportation service, convenient and safe get-on and get-off from the passenger's point of view are enabled. At the same time, the vehicle travel cost is also considered, and therefore, the cost may be minimized, from the standpoint of providing transportation service. At the same time, vehicle travel cost is also considered and therefore, cost may be minimized from the standpoint of providing the transportation service. Furthermore, the expected demand is reflected in determining the parking place, and the travel time for the standby vehicle may be decreased.

In the above-described exemplary embodiment of the present invention, in determining the parking place for the standby vehicle, the total travel time is determined by allocating the expected demand to vehicles currently running in the service area as well as to the standby vehicle. In contrast, in determining the parking places of the standby vehicles, the operation server may determine the total travel time in consideration of the expected demand only for the standby vehicles.

Figure 7:
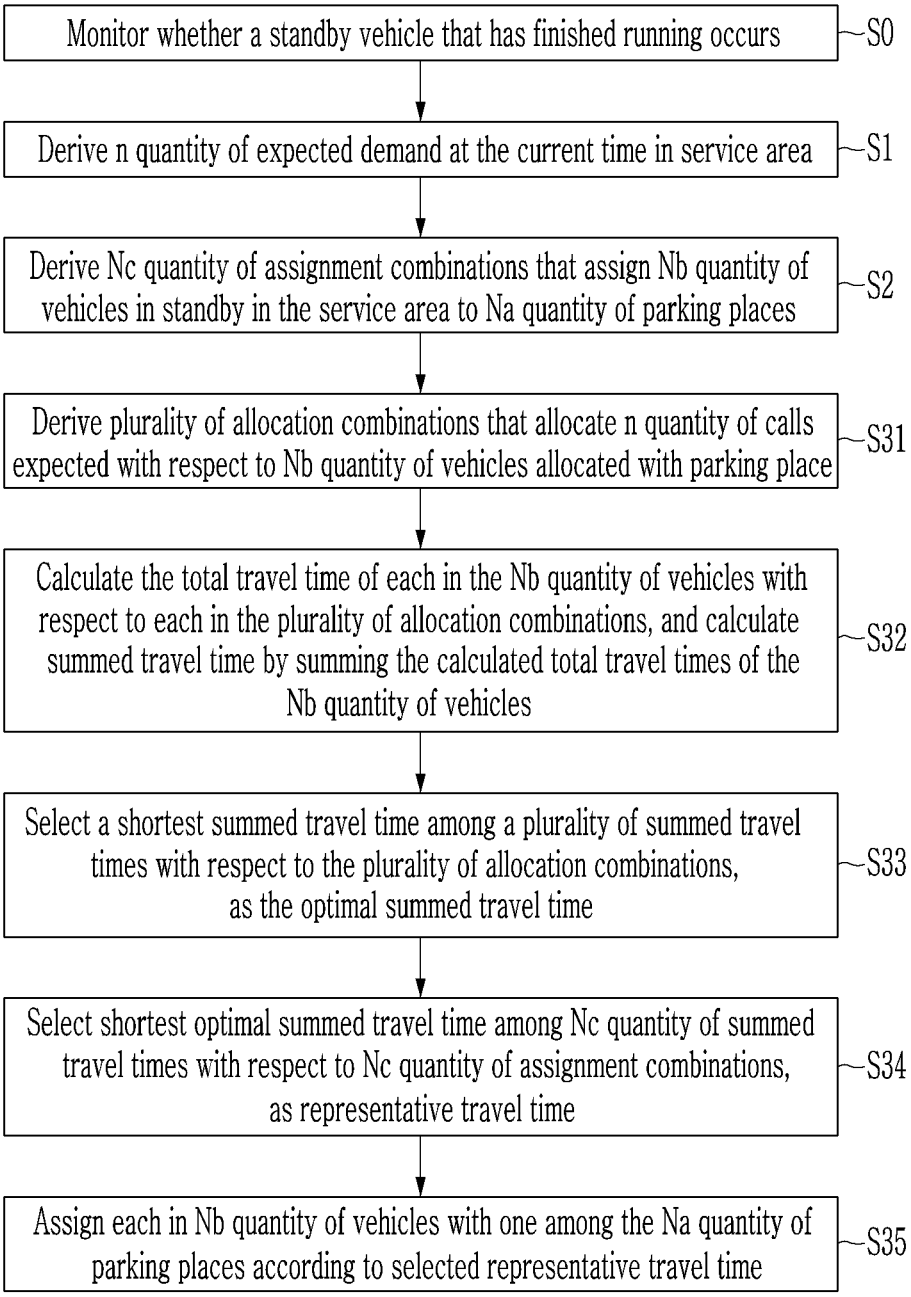
FIG. 7 is a flowchart showing a method for assigning the standby vehicle to a parking place according to an exemplary embodiment of the present invention.

FIG. 7 is a flowchart showing a method for assigning the standby vehicle to a parking place according to an exemplary embodiment of the present invention.

In the description for an exemplary embodiment according to FIG. 7, duplicated explanation with the previous description will be omitted. For example, the configuration of the passenger transportation service system and the operation server shown in FIG. 1 and FIG. 2, the steps S0 to S2 in FIG. 3, the steps shown in FIG. 4 and FIG. 5, and detailed description related thereto are also applicable to an exemplary embodiment of FIG. 7.

At step S31, upon receiving the expected demand from the demand expectation module 60, and upon receiving the Nc quantity of assignment combinations from the vehicle assignment module 70, the vehicle allocation module 80 generates the plurality of allocation combinations that allocate the n quantity of calls expected with respect to the Nb quantity of vehicles allocated with the parking place according to one among the Nc quantity of assignment combinations.

At step S32, with respect to each in the plurality of allocation combinations, the operation server 10 determines the total travel time of each in the Nb quantity of vehicles, and determines the summed travel time by summing the determined total travel times of the Nb quantity of vehicles. In determining the total travel times for the Nb quantity of vehicles, the operation server 10 determines the total travel time to include the time required for each in the Nb quantity of vehicles to move from the current position to the assigned parking place among the Na quantity of parking places according to one among the Nc quantity of assignment combinations.

At step S33, the operation server 10 may select a shortest summed travel time among the plurality of summed travel times for the plurality of allocation combinations. Hereinafter, the shortest summed travel time among the plurality of summed travel times is called the optimal summed travel time.

At step S34, the operation server 10 may select the optimal summed travel time with respect to each in the Nc quantity of assignment combinations, and may select a shortest one among the Nc quantity of the optimal summed travel times with respect to the Nc quantity of assignment combinations, as the representative travel time.

At step S35, the operation server 10 may assign the one among the Na quantity of parking places to each in the Nb quantity of vehicles according to the selected the representative travel time. Furthermore, in determining the parking place, the total travel time of each vehicle is determined in consideration of the expected demand, and also in consideration of the sum of the total travel times of vehicles.

However, the present invention is not limited thereto, and when a current position of a standby vehicle is positioned within a threshold distance range with respect to a specific parking place among a plurality of parking places, the operation server 10 may assign the standby vehicle to the specific parking place. The operation server 10 may exclude a specific vehicle assigned to the parking place among the standby vehicles, and may determine the parking spaces with respect to remaining vehicles according to one of exemplary embodiments described above.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A method for operating a parking place according to demand expectation, the method comprising:

expecting, by an operating server, n quantity of calls corresponding to a current time in a service area, wherein the n is an integer greater than or equal to 1;

determining, by the operating server, Nc quantity of assignment combinations that assign Nb quantity of vehicles in standby in the service area with respect to Na quantity of parking places positioned in the service area, wherein the Na is an integer greater than or equal to 1, the Nb is an integer greater than or equal to 1 and the Nc is an integer greater than or equal to 1, with respect to each in the Nc quantity of assignment combination, allocating, by the operating server, the expected n quantity of calls to Nd quantity of vehicles in the service area including the Nb quantity of vehicles, and determining Nd quantity of total travel times of the Nd quantity of vehicles; and assigning, by the operating server, a corresponding parking place from among the Na quantity of parking places to each in the Nb quantity of vehicles based on the Nd quantity of total travel times with respect to each in the Nc quantity of assignment combination.

2. The method of claim 1, wherein the assigning of the corresponding parking place from among the Na quantity of parking places to each in the Nb quantity of vehicles includes:

determining Nc quantity of representative travel times according to a sum of the Nd quantity of total travel times, with respect to the Nc quantity of assignment combinations; and assigning a corresponding parking place from among the Na quantity of parking places to each in the Nb quantity of vehicles according to a shortest representative travel time among the Nc quantity of representative travel times.

3. The method of claim 2, wherein the determining of the Nd quantity of total travel times includes:

generating a plurality of allocation combinations that allocate the expected n quantity of calls to the Nd quantity of vehicles, with respect to one among the Nc quantity of assignment combinations; and determining the total travel time of each in the Nd quantity of vehicles with respect to each in the plurality of allocation combinations.

4. The method of claim 3, wherein the determining of the Nc quantity of representative travel times includes:

determining a summed travel time by summing the determined total travel times of the Nd quantity of vehicles, with respect to each in the plurality of allocation combinations; and selecting a shortest summed travel time among a plurality of summed travel times with respect to the plurality of allocation combinations as a representative travel time.

5. The method of claim 4, wherein, in the determining of the summed travel time, in determining the total travel times for the Nb quantity of vehicles, a time required for each in the Nb quantity of vehicles to move from a current position to the assigned parking place among the Na quantity of parking places according to the Nc quantity of assignment combinations is disposed in the total travel time.

6. The method of claim 4, wherein the determining of the summed travel time by summing the total travel times of the Nd quantity of vehicles includes:

allocating a plurality of passengers according to one among the plurality of allocation combinations, with respect to each in the Nd quantity of vehicles;

generating a plurality of entire paths for the allocated plurality of passengers, with respect to each in the Nd quantity of vehicles;

determining a plurality of total travel times with respect to the plurality of entire paths, with respect to each in the Nd quantity of vehicles; and selecting a shortest total travel time among the plurality of total travel times, with respect to each in the Nd quantity of vehicles.

7. The method of claim 6, wherein the determining of the plurality of total travel times includes, with respect to each in the plurality of passengers allocated to each in the Nd quantity of vehicles:

setting a plurality of candidate get-on places within a predetermined distance from an origin and a plurality of candidate get-off places within a predetermined distance from a destination;

generating a plurality of get-on-and-off pairs by combination of the plurality of candidate get-on places and the plurality of candidate get-off places;

generating a plurality of entire paths available obtainable by selecting one among the plurality of get-on-and-off pairs; and determining the plurality of total travel times with respect to the plurality of entire paths.

8. The method of claim 7, wherein the determining of the plurality of total travel times includes, with respect to each in the plurality of entire paths:

determining a passenger moving time based on a pre-get-on walking time from the origin to a candidate get-on place, a post-get-off walking time from a candidate get-off place to the destination, and a vehicle travel time required for one vehicle among the Nd quantity of vehicles to travel from the candidate get-on place to the candidate get-off place;

determining a vehicle running time according to a cost for the one vehicle to travel through the candidate get-on place and the candidate get-off place; and determining the total travel time by summing the passenger moving time and the vehicle running time, wherein, in the determining of the vehicle running time, the vehicle is one among the Nb quantity of vehicles, and a time for the vehicle to move from a current position to the assigned parking place among the Na quantity of parking places is disposed in the total travel time.

9. The method of claim 1, further including:

monitoring, by the operating server, whether a standby vehicle that has finished running occurs among the Nd quantity of vehicles, wherein the expecting of the n quantity of calls is performed when the standby vehicle occurs.

10. The method of claim 1, wherein the expecting n quantity of calls includes:

determining an expected demand at the current time by sampling a predetermined quantity of data from call data of a predetermined time period including the current time among an accumulated service call data.

11. The method of claim 1, wherein the determining of the Nc quantity of assignment combinations includes:

generating the Nc quantity of assignment combinations by assigning the Nb quantity of vehicles to each in the Na quantity of parking places while allowing overlapping as many as a number of vehicles to be parked.

12. The method of claim 1, wherein the determining of the Nc quantity of assignment combinations includes:

assigning, when a currently parked vehicle exists in one among the Na quantity of parking places, a remaining number of vehicles excluding the currently parked vehicle from a number of vehicles to be parked in the corresponding parking place, among the Nb quantity of vehicles.

13. The method of claim 1, further including:

assigning, when there exists a first vehicle positioned within a threshold distance range with respect to a first parking place among the Na quantity of parking places among the Nb quantity of vehicles, the first vehicle to the first parking place, wherein the parking place is assigned with respect to remaining vehicles excluding the first vehicle among the Nb quantity of vehicles.

14. An operation server providing a transportation service upon receiving an origin and a destination along with a vehicle call request from a user terminal, the operation server including:

a demand expectation module configured to expect n quantity of calls corresponding to a current time in a service area, wherein the n is an integer greater than or equal to 1;

a vehicle assignment module configured to determine Nc quantity of assignment combinations that assign Nb quantity of vehicles in standby in the service area with respect to Na quantity of parking places positioned in the service area, wherein the Na is an integer greater than or equal to 1, the Nb is an integer greater than or equal to 1 and the Nc is an integer greater than or equal to 1;

a vehicle allocation module configured to allocate the expected n quantity of calls to Nd quantity of vehicles in the service area including the Nb quantity of vehicles according to a plurality of allocation combinations, with respect to each in the Nc quantity of assignment combination; and a total travel time calculation module configured to determine a plurality of total travel times with respect to a plurality of entire paths of each in the Nd quantity of vehicles, with respect to each in the plurality of allocation combinations, wherein the vehicle assignment module is configured to assign a corresponding parking place from among the Na quantity of parking places to each in the Nb quantity of vehicles based on the Nd quantity of total travel times with respect to each in the Nc quantity of assignment combination.

15. The operation server of claim 14, wherein the vehicle assignment module is configured to:

select an optimal summed travel time based on the Nd quantity of total travel times with respect to each in the Nc quantity of assignment combination; and assign a corresponding parking place from among the Na quantity of parking places to each in the Nb quantity of vehicles according to a shortest representative travel time among Nc quantity of optimal summed travel times with respect to Nc quantity of assignment combinations.

16. The operation server of claim 15, wherein the vehicle allocation module is configured to:

generate the plurality of allocation combinations that allocate the expected n quantity of calls to the Nd quantity of vehicles, with respect to one among the Nc quantity of assignment combinations;

select a shortest total travel time from among the determined plurality of total travel times of each in the Nd quantity of vehicles;

determine a summed travel time by summing the shortest total travel time of each in the Nd quantity of vehicles;

select a shortest summed travel time among a plurality of summed travel times with respect to the plurality of allocation combinations as a representative travel time;

select the representative travel time with respect to each in the Nc quantity of assignment combination; and select a shortest one among Nc quantity of representative travel times with respect to the Nc quantity of assignment combinations as the representative travel time.

17. The operation server of claim 16, further including:

an entire path generation module configured to generate a plurality of entire paths for a plurality of passengers according to one among the plurality of allocation combinations, with respect to with respect to each in the Nd quantity of vehicles, wherein the total travel time calculation module is configured to determine the plurality of total travel times with respect to the plurality of entire paths, with respect to each in the Nd quantity of vehicles.

18. The operation server of claim 17, wherein the entire path generation module is configured to, with respect to each of a plurality of passengers allocated to each in the Nd quantity of vehicles:

set a plurality of candidate get-on places within a predetermined distance from the origin and a plurality of candidate get-off places within a predetermined distance from the destination;

generate a plurality of get-on-and-off pairs by combination of the plurality of candidate get-on places and the plurality of candidate get-off places; and generate a plurality of entire paths available obtainable by selecting one among the plurality of get-on-and-off pairs.

19. The operation server of claim 18, further including:

a passenger moving time calculation module configured to determine a passenger moving time based on a pre-get-on walking time from the origin to a candidate get-on place, a post-get-off walking time from a candidate get-off place to the destination, and a vehicle travel time required for one vehicle among the Nd quantity of vehicles to travel from the candidate get-on place to the candidate get-off place, with respect to each in the plurality of entire paths.

20. The operation server of claim 19, further including:

a vehicle running time calculation module configured to determine a vehicle running time according to a cost for the one vehicle to travel through the candidate get-on place and the candidate get-off place, wherein the vehicle running time calculation module is configured to, when the vehicle is the one vehicle of the Nb quantity of vehicles, determine the vehicle running time to include a time for the one vehicle to move from a current position to the assigned parking place among the Na quantity of parking places.

21. The operation server of claim 20, wherein the total travel time calculation module is configured to determine the total travel time by adding a passenger moving time and the vehicle running time with respect to each in the plurality of entire paths, with respect to with respect to each in the Nd quantity of vehicles.

22. The operation server of claim 14, wherein the demand expectation module is configured to determine an expected demand at the current time by sampling a predetermined quantity of data from call data of a predetermined time period including the current time among an accumulated service call data.

23. The operation server of claim 14, wherein the vehicle assignment module is configured to generate the Nc quantity of assignment combinations by assigning the Nb quantity of vehicles to each in the Na quantity of parking places while allowing overlapping as many as a number of vehicles to be parked.

24. The operation server of claim 14, wherein the vehicle assignment module is configured to, when a currently parked vehicle exists in one among the Na quantity of parking places, assign a remaining number of vehicles excluding the currently parked vehicle from a number of vehicles to be parked in the corresponding parking place, among the Nb quantity of vehicles.

25. The operation server of claim 14, further including a monitoring module configured to monitor whether a standby vehicle that has finished running occurs among the Nd quantity of vehicles, wherein the monitoring module is configured to, when the standby vehicle occurs, transmit information on the standby vehicle to the demand expectation module.

26. The operation server of claim 14, wherein the total travel time calculation module is configured to, in determining the total travel times for the Nb quantity of vehicles, determine a total travel time to include a time required for each in the Nb quantity of vehicles to move from a current position to the assigned parking place among the Na quantity of parking places.

27. The operation server of claim 14, wherein the operation server is configured to, when there exists a first vehicle positioned within a threshold distance range with respect to a first parking place among the Na quantity of parking places among the Nb quantity of vehicles, assign the first vehicle to the first parking place, and assign the parking place with respect to remaining vehicles excluding the first vehicle among the Nb quantity of vehicles.

28. A method for operating a parking place according to demand expectation, the method comprising:

expecting, by an operation server, n quantity of calls corresponding to a current time in a service area, wherein the n is an integer greater than or equal to 1;

determining, by the operation server, Nc quantity of assignment combinations that assign Nb quantity of vehicles in standby in the service area with respect to Na quantity of parking places positioned in the service area, wherein the Na is an integer greater than or equal to 1, the Nb is an integer greater than or equal to 1 and the Nc is an integer greater than or equal to 1;

allocating, by the operation server, the expected n quantity of calls to the Nb quantity of vehicles and determining Nb quantity of total travel times of the Nb quantity of vehicles, with respect to each in the Nc quantity of assignment combination; and assigning, by the operation server, a corresponding parking place from among the Na quantity of parking places to each in the Nb quantity of vehicles based on the Nb quantity of total travel times with respect to each in the Nc quantity of assignment combination.

29. The method of claim 28, wherein the assigning of the corresponding parking place from among the Na quantity of parking places to each in the Nb quantity of vehicles includes:

determining Nc quantity of optimal summed travel times based on a sum of the Nb quantity of total travel times, with respect to the Nc quantity of assignment combinations; and assigning a corresponding parking place from among the Na quantity of parking places to each in the Nb quantity of vehicles according to a shortest representative travel time among the Nc quantity of optimal summed travel times.

30. The method of claim 29, wherein the determining of the Nb quantity of total travel times includes:

generating a plurality of allocation combinations that allocate the expected n quantity of calls to the Nb quantity of vehicles, with respect to one among the Nc quantity of assignment combinations; and determining a total travel time of each in the Nb quantity of vehicles with respect to each in the plurality of allocation combinations.

31. The method of claim 30, wherein the determining of the Nc quantity of optimal summed travel times includes:

determining a summed travel time by summing the determined total travel times of the Nb quantity of vehicles with respect to each in the plurality of allocation combinations; and selecting a shortest summed travel time among a plurality of summed travel times with respect to the plurality of allocation combinations, as an optimal summed travel time.

32. The method of claim 28, further including:

assigning, by the operation server, when there exists a first vehicle positioned within a threshold distance range with respect to a first parking place among the Na quantity of parking places among the Nb quantity of vehicles, the first vehicle to the first parking place, wherein the parking place is assigned with respect to remaining vehicles excluding the first vehicle among the Nb quantity of vehicles.

* * * * *